US011891808B2

(12) United States Patent
Zhang et al.

(10) Patent No.: US 11,891,808 B2
(45) Date of Patent: Feb. 6, 2024

(54) ROOF FLASHING

(71) Applicant: Oatey Co., Cleveland, OH (US)

(72) Inventors: Jeffrey Zhang, Henderson, NV (US); Robert F Beesley, Akron, OH (US)

(73) Assignee: Oatey Co., Cleveland, OH (US)

( * ) Notice: Subject to any disclaimer, the term of this patent is extended or adjusted under 35 U.S.C. 154(b) by 0 days.

(21) Appl. No.: 17/578,689

(22) Filed: Jan. 19, 2022

(65) Prior Publication Data

US 2023/0228091 A1 Jul. 20, 2023

(51) Int. Cl.
*E04D 13/147* (2006.01)

(52) U.S. Cl.
CPC ..... *E04D 13/1476* (2013.01)

(58) Field of Classification Search
CPC . E04D 13/143; E04D 13/147; E04D 13/1476; E04D 13/1473; E04D 13/17; E04D 2001/307
See application file for complete search history.

(56) References Cited

U.S. PATENT DOCUMENTS 1,615,929 A * 2/1927 Buckles ..... E04D 13/1476 285/43
1,683,548 A * 9/1928 Hughey ..... E04D 13/1476 126/315
4,864,782 A * 9/1989 Hasty ..... E04D 13/1471 52/60
4,903,997 A * 2/1990 Kifer ..... E04D 13/1476 285/43
6,354,046 B1 3/2002 Swearingen
7,211,037 B2 5/2007 Briggs et al.
7,465,285 B2 12/2008 Hutchinson et al.
7,476,209 B2 1/2009 Gara et al.
7,479,123 B2 1/2009 Briggs
7,503,889 B2 3/2009 Briggs et al.
7,812,085 B2 10/2010 Tse et al.
7,850,634 B2 12/2010 Briggs
7,914,477 B2 3/2011 Briggs et al.
7,939,161 B2 5/2011 Allam et al.
8,117,790 B2 2/2012 Nemazi et al.
8,124,234 B2 2/2012 Weaver et al.
8,263,213 B2 9/2012 Elia et al.
8,288,470 B2 10/2012 Ansems et al.
8,404,780 B2 3/2013 Weaver et al.
8,484,914 B2 7/2013 Cline
8,672,649 B2 3/2014 Smith et al.
(Continued)

FOREIGN PATENT DOCUMENTS

AU 20001/83 A 4/1984
GB 1310059 A * 3/1973 ..... E04D 13/1476
WO WO-2009039562 A1 * 4/2009 ..... E04D 13/1476

*Primary Examiner* — Christine T Cajilig
(74) *Attorney, Agent, or Firm* — BakerHostetler

(57) ABSTRACT

A roof flashing having a base and a flexible collar operatively connected thereto is configured to prevent water infiltration around an exhaust pipe extending through a roof. The base includes a flat plate having a connecting mechanism extending upwardly from the plate. The collar includes either a fixed-diameter opening or a multi-diameter opening thereto, wherein the opening is configured to receive and seal against a pipe extending from the roof to which the roof flashing is attached. The collar is fixedly attached to the connecting mechanism of the base.

17 Claims, 10 Drawing Sheets

(56) References Cited

U.S. PATENT DOCUMENTS

| | | | |
|---|---|---|---|
| 8,743,203 | B2 | 6/2014 | Karner et al. |
| 8,896,700 | B2 | 11/2014 | Karner et al. |
| 8,916,270 | B2 | 12/2014 | Malinoski et al. |
| 8,976,247 | B1 | 3/2015 | Karner et al. |
| 8,981,013 | B2 | 3/2015 | Silvis et al. |
| 9,023,939 | B2 | 5/2015 | Ansems et al. |
| 9,183,749 | B2 | 11/2015 | Karner et al. |
| 9,238,097 | B2 | 1/2016 | Briggs |
| 9,440,586 | B2 | 9/2016 | Karner et al. |
| 9,458,859 | B2 | 10/2016 | Fizer |
| 9,688,028 | B2 | 6/2017 | Mark et al. |
| 9,694,544 | B2 | 7/2017 | Mark et al. |
| 9,796,331 | B2 | 10/2017 | Karner et al. |
| 9,815,268 | B2 | 11/2017 | Mark et al. |
| 9,821,708 | B2 | 11/2017 | Salter et al. |
| 9,938,400 | B2 | 4/2018 | Sahnoune et al. |
| 9,994,144 | B2 | 6/2018 | Dellock et al. |
| 10,000,151 | B2 | 6/2018 | Dubosc |
| 10,046,688 | B2 | 8/2018 | Salter et al. |
| 10,091,418 | B2 | 10/2018 | Alvarado-Moya et al. |
| 10,118,538 | B2 | 11/2018 | Salter et al. |
| 10,144,353 | B2 | 12/2018 | Karner et al. |
| 10,259,160 | B2 | 4/2019 | Mark |
| 10,308,180 | B2 | 6/2019 | Karner et al. |
| 10,350,416 | B2 | 7/2019 | Bonner et al. |
| 10,470,847 | B2 | 11/2019 | Shanjani et al. |
| 10,556,055 | B2 | 2/2020 | Briggs |
| 10,556,542 | B2 | 2/2020 | Karner et al. |
| 10,562,442 | B2 | 2/2020 | Salter et al. |
| 10,589,087 | B2 | 3/2020 | Tyler et al. |
| 10,603,841 | B2 | 3/2020 | Mark et al. |
| 10,647,185 | B2 | 5/2020 | Grimaldo et al. |
| 10,682,844 | B2 | 6/2020 | Mark |
| 10,696,039 | B2 | 6/2020 | Mark et al. |
| 10,703,274 | B2 | 7/2020 | Karner et al. |
| 10,771,692 | B2 | 9/2020 | Alvarado-Moya et al. |
| 10,773,044 | B2 | 9/2020 | Dantanarayana et al. |
| 10,800,331 | B1 | 10/2020 | Karner et al. |
| 10,888,396 | B2 | 1/2021 | Shanjani et al. |
| 10,888,681 | B2 | 1/2021 | Baigent et al. |
| 11,118,353 | B2 * | 9/2021 | Stearns ..... H02S 30/00 |
| 2009/0051079 | A1 * | 2/2009 | Ronan ..... E04D 13/031 264/327 |
| 2017/0089346 | A1 | 3/2017 | Oleson et al. |
| 2018/0022032 | A1 | 1/2018 | Mark et al. |
| 2018/0257282 | A1 | 9/2018 | Neerincx et al. |
| 2019/0009472 | A1 | 1/2019 | Mark |
| 2019/0269871 | A1 | 9/2019 | Kenyon et al. |
| 2019/0351173 | A1 | 11/2019 | Dantanarayana et al. |
| 2020/0039180 | A1 | 2/2020 | Davis et al. |
| 2020/0091608 | A1 | 3/2020 | Alpman et al. |
| 2020/0197086 | A1 | 6/2020 | Azamian et al. |
| 2020/0197655 | A1 | 6/2020 | Shelly et al. |
| 2020/0208009 | A1 | 7/2020 | Westhoff et al. |
| 2020/0337765 | A1 | 10/2020 | Smith |
| 2020/0366841 | A1 | 11/2020 | Alvarado-Moya et al. |
| 2020/0368478 | A1 | 11/2020 | Baluchagi et al. |
| 2020/0368481 | A1 | 11/2020 | Dantanarayana et al. |
| 2020/0376221 | A1 | 12/2020 | Eves et al. |
| 2020/0377692 | A1 | 12/2020 | Grosser et al. |
| 2020/0384264 | A1 | 12/2020 | Tyler et al. |
| 2021/0023995 | A1 | 1/2021 | Karner et al. |
| 2021/0069442 | A1 | 3/2021 | Baigent et al. |

* cited by examiner

ROOF FLASHING

TECHNICAL FIELD

The present invention is directed to roof flashings, and more particularly, to roof flashings having a flexible pipe collar.

BACKGROUND

Roof flashings have been used to provide a sealed connection between the roof and a vent pipe or the like that extends above the roof, wherein the roof flashing is configured to prevent water or ice damage by preventing infiltration of water into the roofing materials between the pipe and the hole through which the pipe extends through the roof. Roof flashings are typically attached to the roof surrounding the pipe, and the roof flashings often include a flexible collar through which the pipe extends. The flexible collar is configured to provide a seal between the collar and the pipe to prevent water inflow that can cause damage to the structural materials of the roof surrounding the pipe.

SUMMARY

A roof flashing of the present invention is provided. The roof flashing includes a base having a plate, wherein the plate has a top surface. The base also includes a connecting mechanism extending at an angle from the top surface of the plate. The connecting mechanism defines a central aperture formed through the base. The base further including a diverter extending from the top surface of the plate. The diverter surrounds at least a portion of the connecting mechanism and is spaced apart therefrom. The roof flashing also includes a flexible collar operatively connected to the connecting mechanism of the base. The flexible collar has an opening for receiving and sealing against a pipe extending from the roof.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
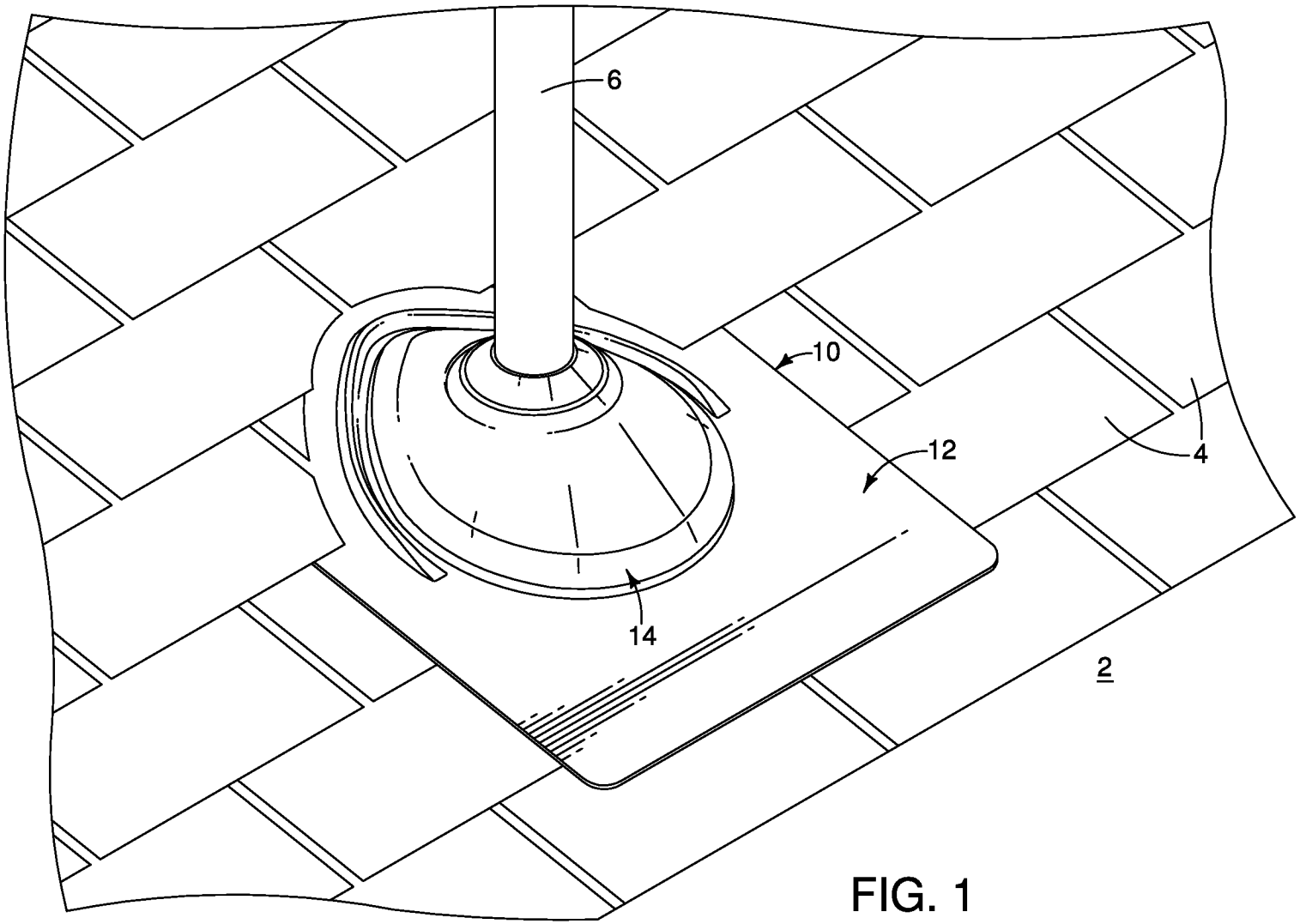
FIG. 1 is a top perspective view of an exemplary embodiment of a roof flashing installed on a roof.

Referring to FIG. 1, an exemplary embodiment of a roof flashing 10 installed on a roof 2 is shown. The roof flashing 10 is configured to be positioned on a roof 2 or other surface of a building, wherein the roof flashing 10 surrounds a pipe 6—such as a plumbing vent stack, a fan port, or the like—that is extending out of a building. The roof flashing 10 provides a self-sealing connection with the pipe 6. The roof flashing 10 is surrounded by, and at least partially covered by, roof shingles 4, metal roof panels, or other roofing materials to prevent water infiltration into the underlying roof structure. The roof flashing 10 is configured to provide a water-tight seal around a pipe 6 protruding from the building to prevent water from seeping around the pipe 6 and damaging the structural integrity of the roof 2 surrounding the pipe.

Figure 2:
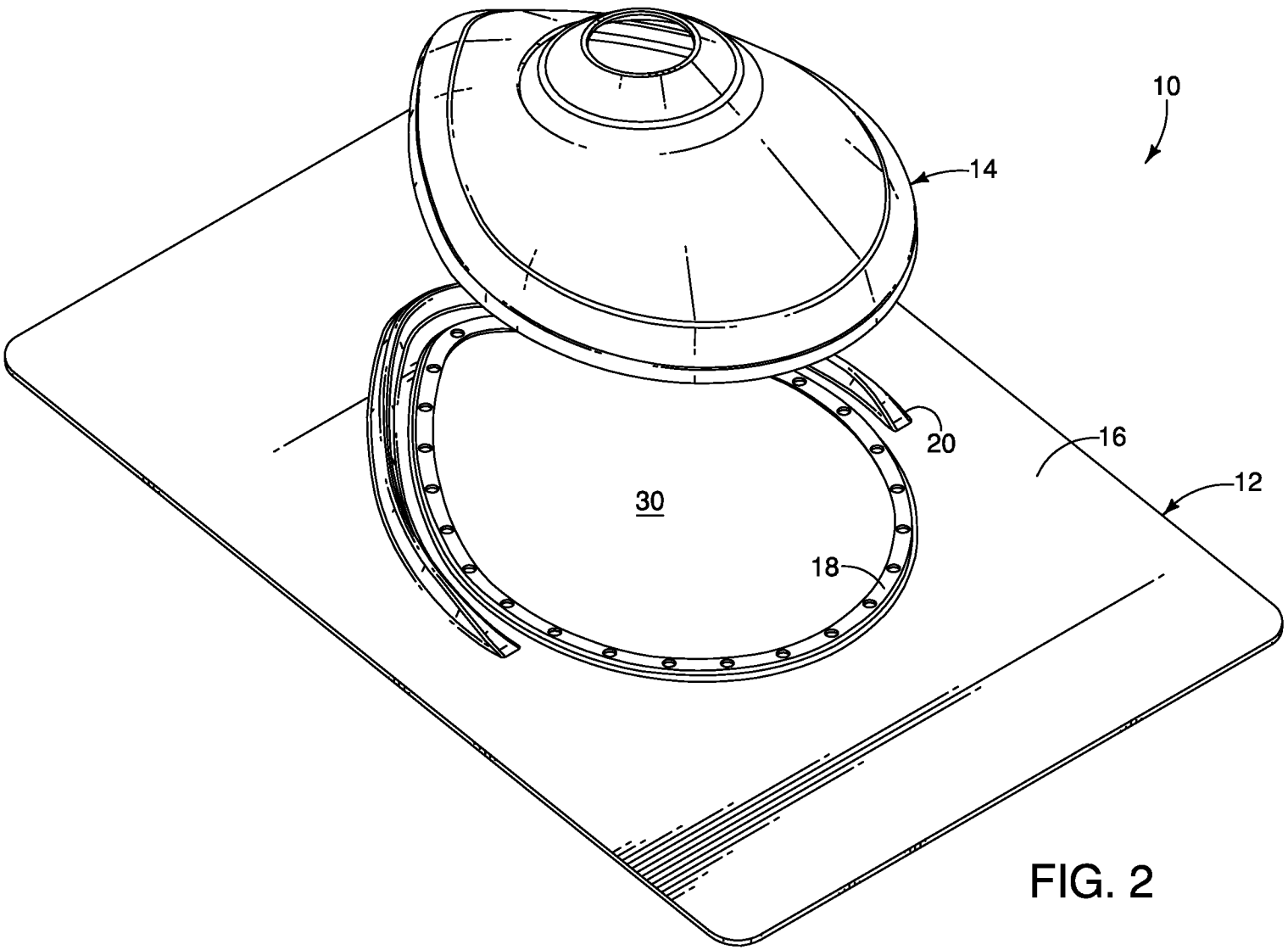
FIG. 2 is an exploded view of the roof flashing shown in FIG. 1.

In the embodiment illustrated in FIGS. 1-2, the roof flashing 10 includes a base 12 and a collar 14 operatively connected thereto. The collar 14 is formed separately from the base 12 and is fixedly attached thereto. The collar 14 is attached to the base 12 in sealed connection to prevent infiltration of water or ice between the interface between the collar 14 and base 12. In an embodiment, the collar 14 is overmolded onto the base 12, as shown in FIG. 6. In other embodiments, the collar 14 is attached to the base 12 by way of crimping the base 12 onto the edge of the collar 14. In further embodiments, the collar 14 is attached to the base 12 by glue, rivets, or any other attachment mechanism capable of creating a fully sealed connection between the collar 14 and the base 12. It should be understood by one having ordinary skill in the art that the collar 14 can be attached to the base 12 in any manner that prevents separation of the parts while maintaining leak protection therebetween that is also capable of withstanding years of exposure to all types of extreme weather. The base 12 can be formed of metal or a hard plastic material. More particularly, the base 12 can be formed of aluminum, galvanized steel, copper, or hardened plastic, in addition to other materials used for roof flashings.

Figure 3:
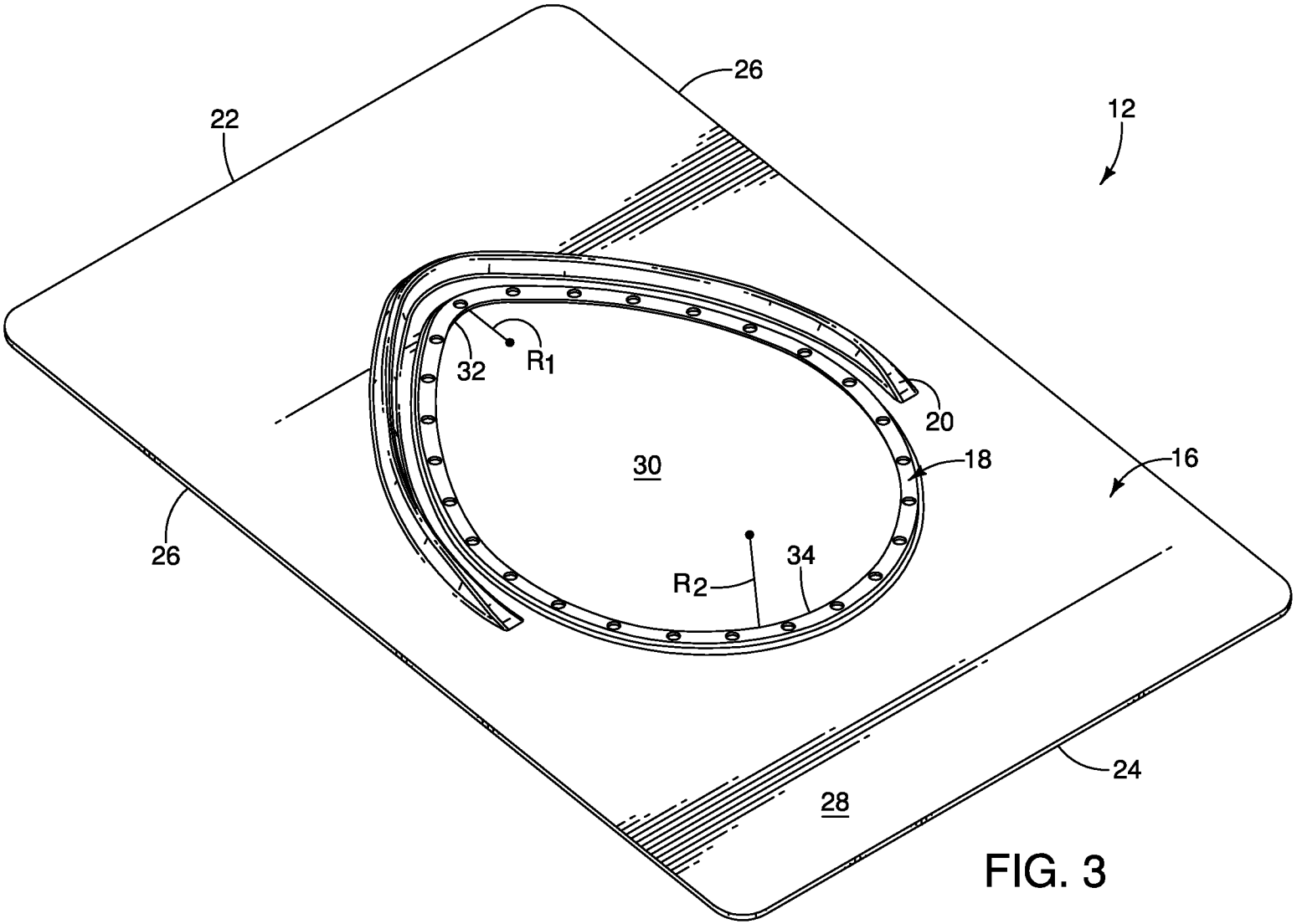
FIG. 3 is an exemplary embodiment of a base of the roof flashing.

FIGS. 2-3 illustrate an exemplary embodiment of a base 12 of the roof flashing 10. The base 12 is a generally flat, rectangular member having a length in the longitudinal (or longer) direction and a width in the transverse direction relative to the longitudinal direction. The base 12 includes a plate 16 and a connecting mechanism 18 integrally formed with the plate. In some embodiments, the plate 16 further includes a diverter 20 extending from the plate 16 and positioned adjacent to the connecting mechanism 18. The connecting mechanism 18 extends at an angle from an upper surface 28 of the plate 16. The plate 16 of the base 12 includes a top edge 22, an opposing bottom edge 24, opposing lateral edges 26, and an upper surface 28. The roof flashing 10 is aligned on a roof 2 such that the longitudinal direction between the top and bottom edges 22, 24 is directed up-slope such that the top edge 22 of the base 12 is directed toward the peak of a roof 2. The width of the base 12 is defined between the opposing lateral edges 26 of the plate 16. The longitudinal dimension of the base 12 allows for at least one shingle 4 (FIG. 1) to overlap the top edge 22 and a portion of the upper surface 28 of the plate 16 as it extends over the top edge 22. The shingle 4 that overlaps the top edge 22 allows water to flow down-slope from the shingle 4 to the upper surface 28 of the plate 16. The shingle(s) 4 overlapping the upper surface 28 are typically trimmed or cut to accommodate the shape of the collar 14 and the connecting mechanism 18 to prevent contact therebetween. The width of the base 12 allows for shingles 4 to overlap a portion of the upper surface 28 of the plate 16 as they extend over each of the opposing lateral edges 26 of the plate 16. The bottom edge 24 of the plate 16 is configured to overlap the adjacent row of shingles 4 below the bottom portion of the plate 16 such that water that flows over the upper surface 28 of the plate 16 is able to continue flowing down-slope onto the shingles 4 below the bottom edge 24 of the plate 16. The roof flashing 10 is typically attached to the roof 2 using nails hammered through the plate 16 and into the roof 2. In some installation methods, a bead of caulk may be placed onto the lower surface of the plate 16 before the base 12 is secured to the roof 2 with nails or the like.

Figure 4:
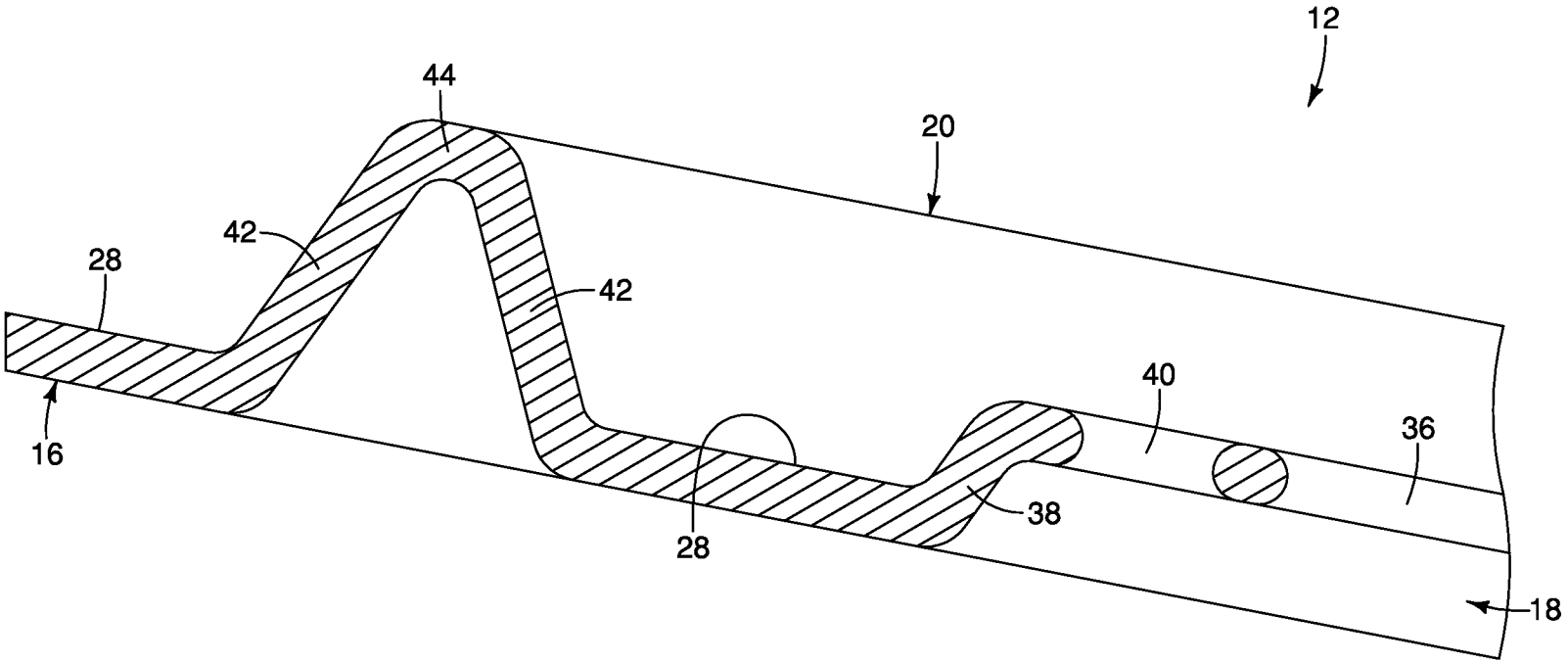
FIG. 4 is a magnified view of the connecting mechanism of the base of the roof flashing.

In the embodiment illustrated in FIGS. 2-4, the connecting mechanism 18 of the plate 16 of the base 12 extends from the plate 16 at an angle. The connecting mechanism 18 defines a central aperture 30 therethrough. In an embodiment, the connecting mechanism 18 is generally teardrop-shaped, thereby defining a similarly shaped central aperture 30. In other embodiments, the central aperture 30 is formed as a round, oblong, oval, or other shape having rounded corners that corresponds to the shape of the connecting mechanism 18 extending from the plate 16. The connecting mechanism 18 includes a top end 32 directed toward the top edge 22 of the plate 16. In the illustrated embodiment, the top end 32 of the connecting mechanism 18 is rounded and has a first radius of curvature $R_1$. The connecting mechanism 18 also includes a bottom end 34 directed toward the bottom edge 24 of the plate 16. The bottom end 34 of the connecting mechanism 18 is rounded and has a second radius of curvature $R_2$. In the illustrated embodiment, the first radius of curvature $R_1$ is smaller than the second radius of curvature $R_2$, thereby forming a general teardrop-shaped connecting mechanism 18. In other embodiments, the first and second radii of curvature $R_1$, $R_2$ are the same, thereby forming a round- or oval-shaped connecting mechanism 18. The longitudinal direction of the connecting mechanism 18 (between the top and bottom ends 32, 34) is aligned with or generally parallel to the longitudinal direction of the base 12, wherein the top end 32 of the connecting mechanism 18 is closest to the top edge 22 of the plate 16. It should be understood by one having ordinary skill in the art that the central aperture 30 can be shaped differently than the teardrop-shape of the illustrated embodiment while still maintaining the same general form and function. For bases 12 formed of metal, the connecting mechanism 18 is formed by a stamping or molding process.

The connecting mechanism 18 of the plate 16 of the base 12 extends above the upper surface 28 of the plate 16, as shown in FIGS. 2-4. In the illustrated embodiment, the connecting mechanism 18 is formed as a flange 36 and a transition 38 that extends between the base 12 and the flange 36. The inner edge of the flange 36 defines the central aperture 30. The flange 36 is integrally connected to the upper surface 28 by way of a transition 38, wherein the transition 38 extends between the plate 16 and the flange 36. The flange 36 is formed as a generally flat, or planar member being oriented substantially parallel to the upper surface 28 of the base 12. In other embodiments, the flange 36 is oriented in a non-parallel relationship relative to the upper surface 28 for purposes of ease of overmolding. The transition 38 spaces the flange 36 away from the upper surface 28 so that the interconnection between the flange 36 of the base 12 and the collar 14 is positioned slightly above the upper surface 28 of the base 12. This spacing ensures that the connection between the plate 16 and the collar 14 is located above the upper surface 28 of the plate 16. This spacing also provides for a thicker, more robust overmolding surrounding the connecting mechanism 18 which provides a sturdy base for the collar 14 to better withstand inclement weather conditions. The transition 38 extends from the upper surface 28 of the plate 16 at an angle. In the illustrated embodiment, the transition 38 extends from the upper surface 28 at a non-perpendicular angle. The angle at which the transition 38 extends form the upper surface 28 is between about 45° to about 90°. In other embodiments, the transition 38 extends from the upper surface 28 at a perpendicular angle. The flange 36 is integrally formed with an extends at an angle from the transition 38, whereby the transition 38 and flange 36 form a generally L-shaped or Z-shaped extension above the upper surface 28.

In the illustrated embodiment, the flange 36 of the connecting mechanism 18 of the base 12 includes a plurality of apertures 40 formed through the thickness thereof, as shown in FIGS. 2-4. The apertures 40 are configured to enable a secure bond between the flange 36 of the connecting mechanism 18 and the collar 14 when the collar 14 is overmolded onto the base 12. In the illustrated embodiment, the apertures 40 have a generally circular shape, but it should be understood by one having ordinary skill in the art that the apertures 40 can be formed of any shape. The apertures 40 are spaced apart about the entire circumference of the flange 36. In some embodiments, the apertures 40 are evenly spaced about the flange 36. In other embodiments, the apertures 40 are more tightly spaced relative in one or more portions of the flange 36 whereas the apertures 40 can be spaced apart more in other portion(s) of the flange 36. The apertures 40 allow an amount of rubber or overmolding material to extend therethrough to provide additional surface area of connection between the collar 14 and the base 18, which increases the difficulty of separating the collar 14 from the base 12 as a result of wind shear or the freezing/thawing of water that may become trapped between the collar 14 and connecting mechanism 18.

The teardrop shape of the connecting mechanism 18 provides a much smaller radius of curvature at the top end 32 of the thereof, wherein the small radius of curvature $R_1$ significantly reduces or eliminates the potential collection of water along the corner formed between the transition 38 and the upper surface 28 adjacent to the top edge 22 of the plate 16. The small radius of curvature at the top end 32 of the connecting mechanism 18 causes water flowing down-slope across the upper surface 28 toward the bottom edge 24 of the plate 16 to quickly and easily flow around the sides of the connecting mechanism 18, thereby preventing water from pooling against the connecting mechanism 18 and on the upper surface 28 at the top end 32 of the connecting mechanism 18.

To further reduce or eliminate the potential pooling or accumulation of water and ice on the upper surface 28 of the base 12, the base 12 further includes a diverter 20 extending upwardly from the upper surface 28 of the plate 16, as shown in FIGS. 2-4. In the illustrated embodiment, the diverter 20 extends partially about the circumference of the connecting mechanism 18. In other embodiments, the diverter 20 extends about the entire circumference of the connecting mechanism 18. In the illustrated embodiment, the diverter 20 is spaced apart from the connecting mechanism 18 such that a portion of the upper surface 28 is disposed therebetween. In other embodiments, the diverter 20 abuts at least a portion of the connecting mechanism 18 such that the diverter 20 immediately transitions to the connecting mechanism 18 in which no portion of the upper surface 28 is disposed therebetween. The diverter 20 is positioned adjacent to the portion of the connecting mechanism 18 closest to the top edge 22 of the plate 16 such that the diverter 20 is directed up-slope on the roof 2 when the roof flashing 10 is installed. The diverter 20 is configured to direct water and ice flowing or sliding down-slope on the upper surface 28 of the base 12 toward the bottom edge 24 of the plate 16 around the connecting mechanism 18 and collar 14, thereby reducing the amount of water and ice that can accumulate or pool adjacent to the uppermost portion of the connecting mechanism 18. In the illustrated embodiment, the diverter 20 extends at least partially about the connecting mechanism 18, wherein the diverter 20 is positioned between the transition 38 of the connecting mechanism 18 and the lateral edges 26 of the plate 16 as well as between the transition 38 of the connecting mechanism 18 and the top edge 22 of the plate 16. The diverter 20 is formed as a truncated teardrop shape, wherein the shape of the diverter 20 has substantially the same shape as the portions of connecting mechanism 18 located adjacent thereto.

In the illustrated embodiment, the diverter 20 has a generally V-shaped cross-sectional shape, as shown in FIG. 4. The V-shaped diverter 20 includes a pair of legs 42 that each extends at an angle from the upper surface 28 of the plate 16, and the pair of legs 42 join together at an apex 44 located at a height above the upper surface 28. In the illustrated embodiment, the apex 44 is formed as a generally a flattened portion. In other embodiments, the apex 44 is formed as a generally rounded intersection between the legs 42. In other embodiments, the cross-sectional shape of the diverter 20 can be generally square, rectangular, half-round, or any other shape sufficient to provide a raised member extending above the upper surface 28 of the base 12 to re-direct water and ice around the transition 38 of the connecting mechanism 18.

Figure 5A:
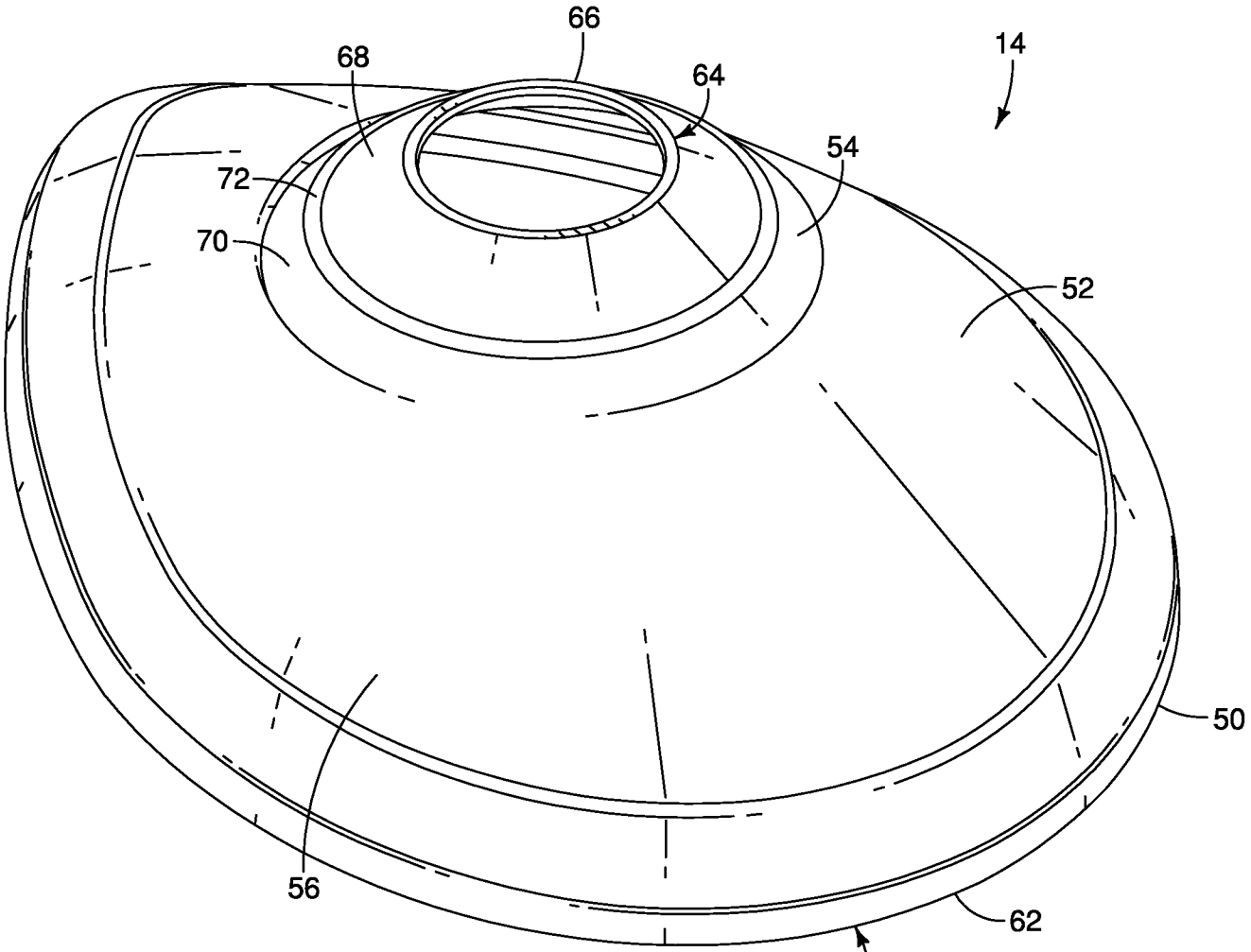
FIG. 5A is a top perspective view of a first embodiment of the collar of the roof flashing.
Figure 5B:
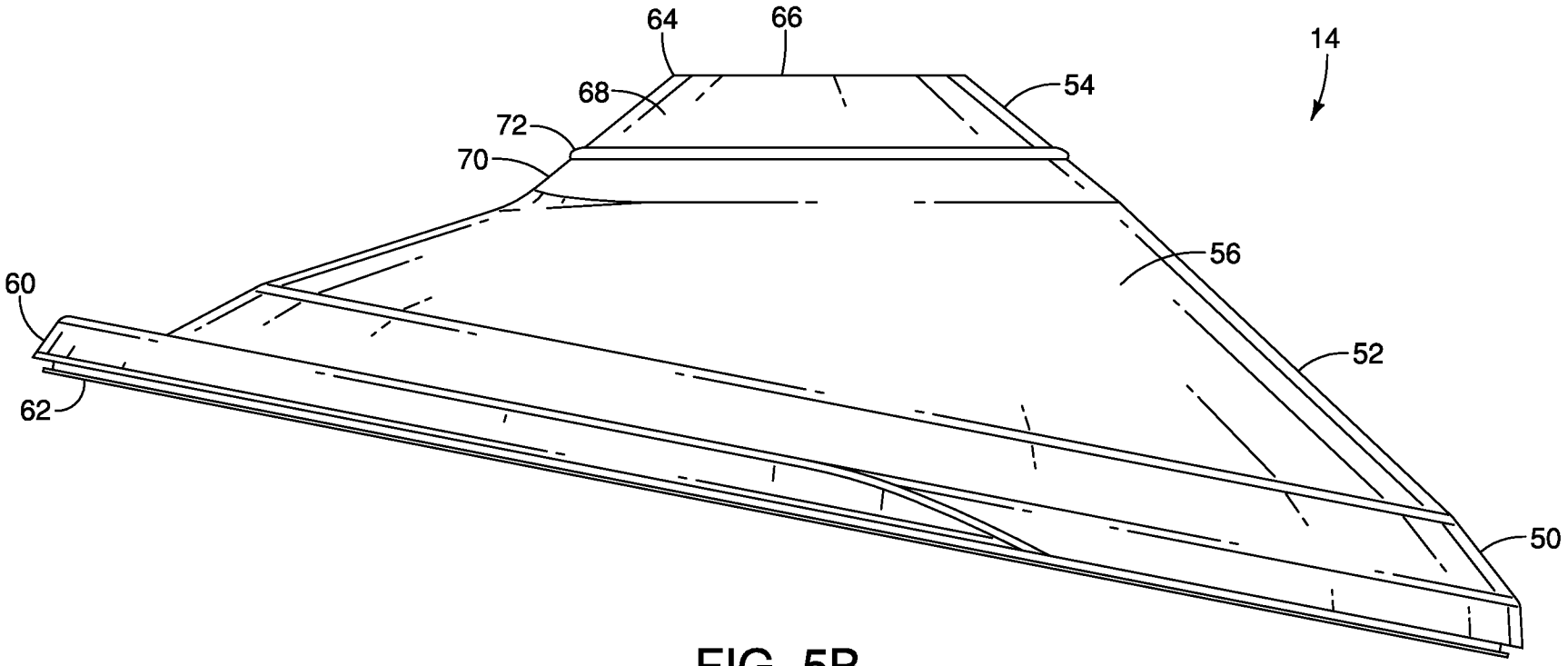
FIG. 5B is a side view of the collar shown in FIG. 5A.
Figure 5C:
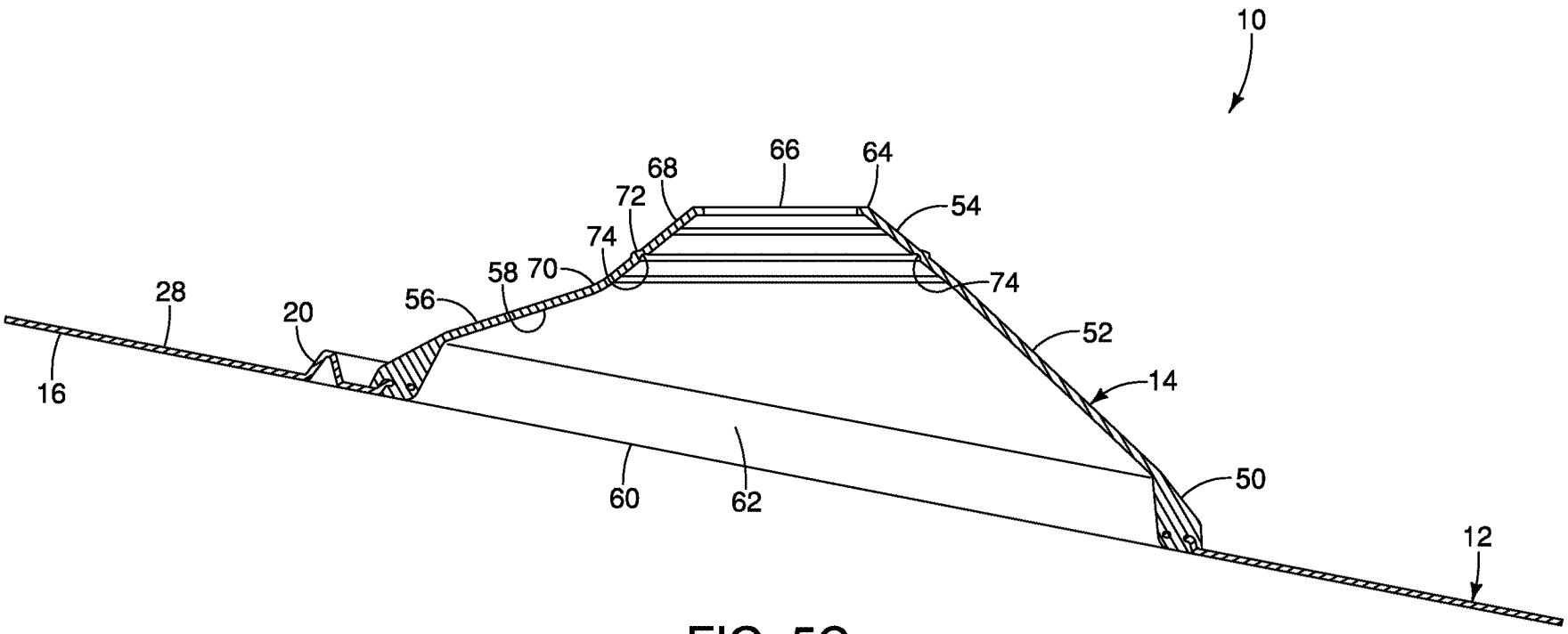
FIG. 5C is a cross-sectional view of an embodiment of the roof flashing with the collar shown in FIGS. 5A-5B.

FIGS. 5A-5C illustrate a first embodiment of a collar 14 of the roof flashing 10. The collar 14 is formed from a flexible material such as rubber or a thermoplastic elastomer (TPE). In other embodiments, the collar 14 can be formed of other types of flexible rubber that have an extended life in outdoor environments being subjected to various weather extremes. In the illustrated embodiment, the collar 14 includes a connecting portion 50, a sloped portion 52 extending from the connecting portion 50, and a sealing portion 54 extending from the sloped portion 52. In other embodiments, the collar 14 can include additional portions or sections positioned between these portions. The collar 14 is a generally hollow member having an outer surface 56 and an opposing inner surface 58. The collar 14 further includes a connecting end 60 defining a first opening 62 and an opposing sealing end 64 defining a second opening 66. The connecting end 60 is configured to be secured or otherwise attached to the base 12, and the sealing end 64 is configured to provide a seal between the collar 14 and a pipe 6.

As shown in FIGS. 5A-5C, the second opening 66 of illustrated embodiment of the collar 14 a substantially circular aperture or opening into the cavity within the collar 14. The illustrated collar 14 is configured as a multi-diameter collar 14, wherein the diameter of the second opening 66 can be changed by removing portions of the sealing portion 54 of the collar 114. The embodiment illustrated in FIGS. 5A-5C is a 3-in-1 roof flashing 10, wherein the second opening 66 of the collar 14 can be selectively adjustable to fit three different pipe diameters. The sealing portion 54 of the collar 14 includes a first removable ring 68. The first removable ring 68 is configured to be detached from the sloped portion 52 of the collar 14. The sealing portion 54 is formed as a generally truncated cone shape, wherein the first removable ring 68 is formed as a truncated cone having a substantially circular upper and lower end, wherein the lower end has a larger diameter than the upper end. The first removable rings 68 is selectively removed from the collar 14 to increase the effective diameter of the second opening 66. For example, FIGS. 5A-5C shows the first removable ring 68 and the sloped portion 52 being attached and integrally formed together. The diameter of the second opening 66 defined by the upper edge of the first removable ring 68 is one and one-half inches (1.5"), so the second opening 66 as-molded can receive a pipe 6 having a diameter of 1.5" and 2". In order to increase the diameter of the second opening 66, the first removable ring 68 is detached from the sloped portion 52, thereby exposing an upper edge of the sloped portion 52. As a result, the diameter of the second opening 66 defined by the upper edge (now exposed) of the sloped portion is three inches (3") to receive a 3" pipe 6. It should be understood by one having ordinary skill in the art that the multi-diameter collar 14 can be configured as a 2-in-1 configuration, a 3-in-1 configuration, a 4-in-1 configuration, or any other configuration that provides a user-selectable diameter of the second opening 66 to receive any conventional pipe diameter. The adjustable diameter of the second opening 66 can be 1", 1.5", 2", 2.5", 3", 4", or any other diameter in either metric or English measurements.

In the embodiment of the multi-diameter collar 14 illustrated in FIGS. 5A-5C, a raised rib 72 extends from the outer surface 56 of the collar 14 at the intersection of the first and second removable rings 68, 70. The rib 72 is configured to provide a guide for separating the first removable ring 68 from the second removable ring 70. A groove 74 is also formed into the inner surface 58 of the collar 14 opposite the rib 72. The groove 74 is configured to further provide a guide for separating the first and second removable rings 68, 70 by providing a narrowed thickness of the collar wall to make it easier for the first and second removable rings 68, 70 to be separated.

The sloped portion 52 of the collar 14, as shown in FIGS. 5A-5C, extends between is integrally formed with the sealing portion 54 and the connecting portion 50. The upper end of the sloped portion 52 is generally circular and corresponds to shape of the lower end of the sealing portion 54, and the lower end of the sloped portion 52 is generally teardrop-shaped and corresponds to the shape of the upper end of the connecting portion 50. The wall of the sloped portion 52 that extends between the sealing portion 54 and the connecting portion 50 is sloped to allow rain and snow to be guided away from the second opening 66 at the upper end of the collar 14.

Figure 7:
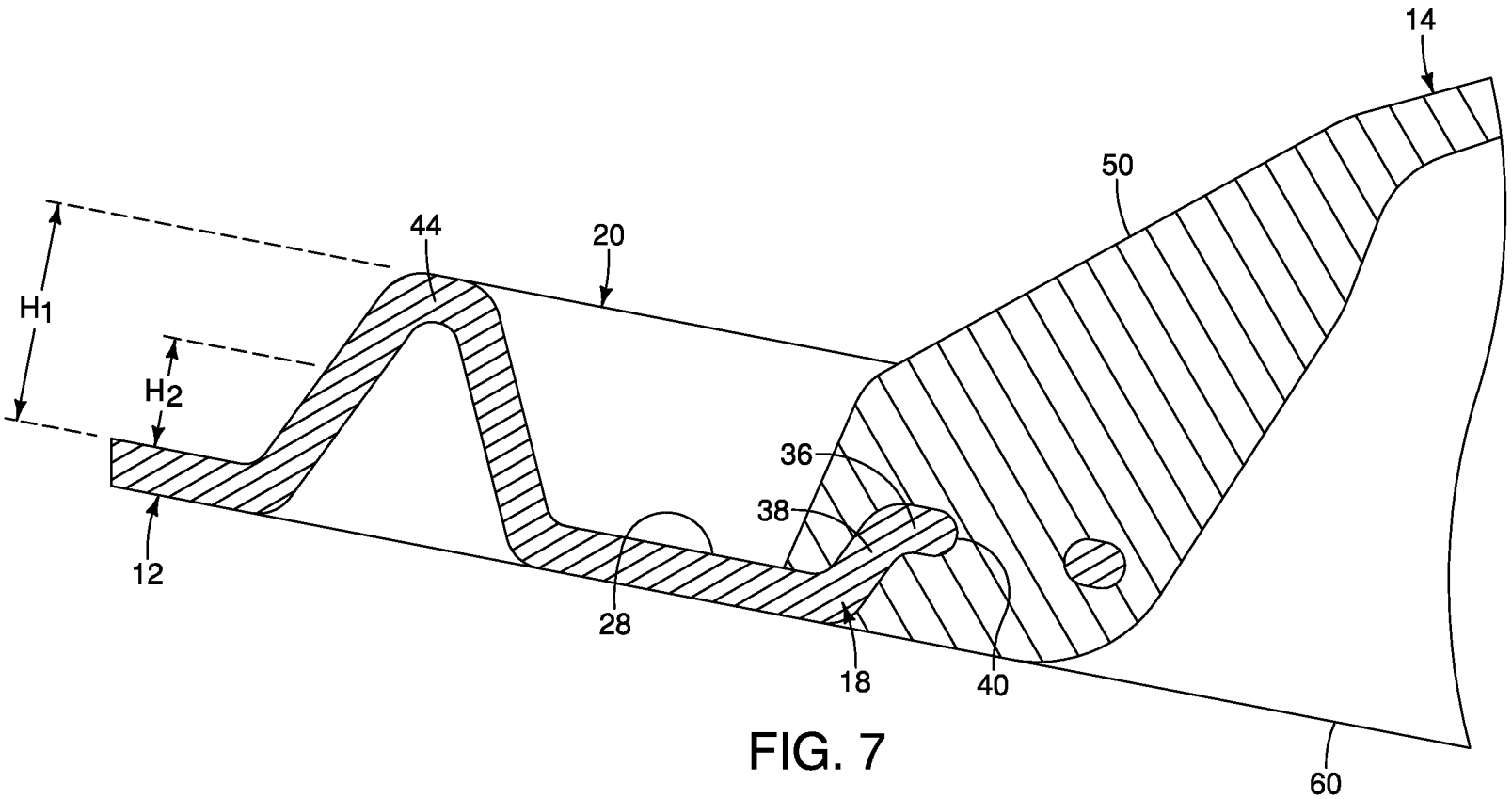
FIG. 7 is a magnified view of the overmolded connection between the collar and the base of the roof flashing.

The connecting portion 50 of the collar 14 extends from the sloped portion 52 and is configured to provide a connection between the collar 14 and the base 12, as shown in FIGS. 5C and 7. The connecting portion 50 of the collar 14 is configured to be connected to the connecting mechanism 18 of the base 12. In some embodiments, the connecting portion 50 is formed as a generally teardrop-shaped toroid having a rhomboid cross-sectional shape. It should be understood by one having ordinary skill in the art that the cross-sectional shape of the connecting portion 50 can be square, rectangular, round, oval, or any other shape sufficient to completely surround and encase at least a portion of the connecting mechanism 18 of the base 12. The cross-section of the connecting portion 50 that connects to the base 12 is consistent as it extends about the circumference of the flange 36 of the base 12. The connecting portion 50 is a thickened portion of the collar 14 that provides a structural base and prevents or eliminates the buckling of the sloped and sealing portions 52, 54 during extended use. The connecting portion has a generally teardrop shape that corresponds to the shape of the flange 36 of the connecting mechanism 18 of the base 12. It should be understood by one having ordinary skill in the art that the shape of the connecting portion 50 of the collar 14 should be the same as the shape of the connecting mechanism 18 of the base 12 to provide a complete seal between the components to prevent water or ice infiltration therebetween.

Figure 6A:
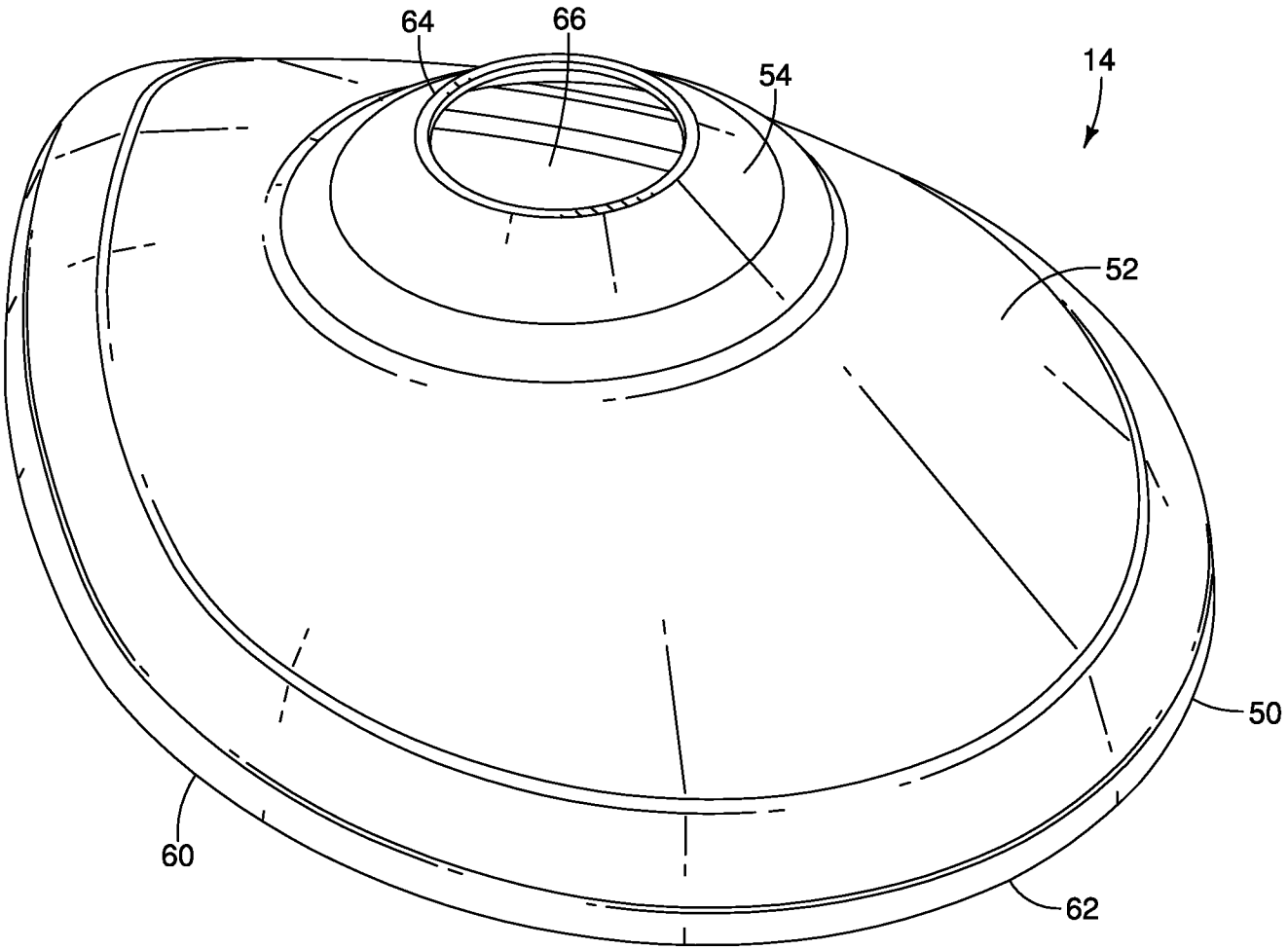
FIG. 6A is a top perspective view of another embodiment of the collar of the roof flashing.
Figure 6B:
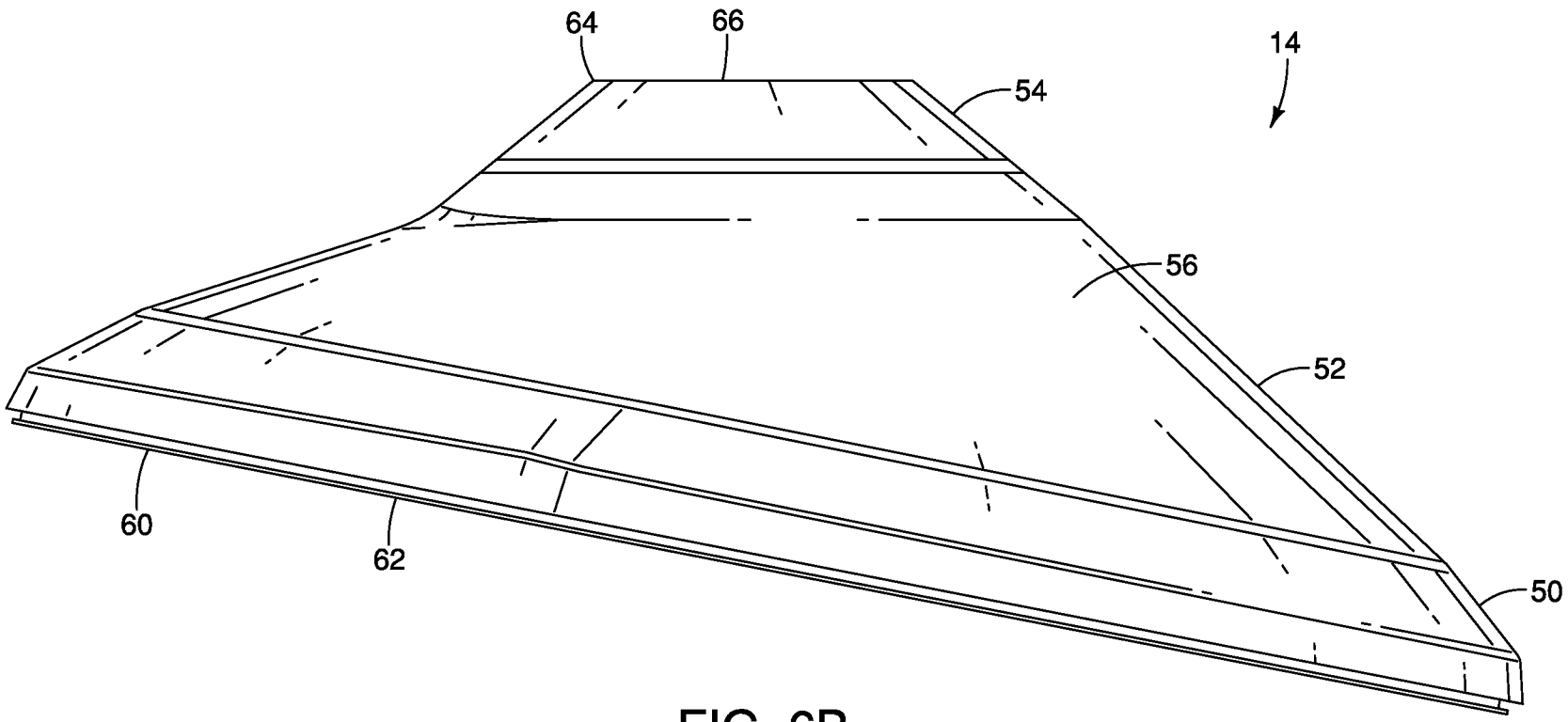
FIG. 6B is a side view of the collar shown in FIG. 6A.

FIGS. 6A-6B illustrate another embodiment of a collar 14 of the roof flashing 10. In the illustrated embodiment, the collar 14 includes a connecting portion 50, a sloped portion 52 extending from the connecting portion 50, and a sealing portion 54 extending from the sloped portion 52. In other embodiments, the collar 14 can include additional portions or sections positioned between these portions. The collar 14 further includes a connecting end 60 defining a first opening 62 and an opposing sealing end 64 defining a second opening 66. The connecting end 60 is configured to be secured or otherwise attached to the base 12, and the sealing end 64 is configured to provide a seal between the collar 14 and a pipe 6.

As shown in FIGS. 6A-6B, the second opening 66 of illustrated embodiment of the collar 14 a substantially circular aperture or opening into the cavity within the collar 14. The collar 14 is configured as a fixed-diameter collar, wherein the diameter of the second opening 66 corresponds to the diameter of the pipe 6 received within the second opening 66. The diameter of the second opening 66 of a fixed-diameter collar 14 can be one inch (1"), two inches (2"), three inches (3"), four inches (4"), or other diameter in either English or metric units configured to receive pipes 6 having corresponding diameters. As illustrated, the second opening 66 is a round aperture configured to receive a round pipe 6 therein to provide a seal between the roof flashing 10 and the pipe 6.

The sloped portion 52 of the collar 14, as shown in FIGS. 6A-6B, extends between is integrally formed with the sealing portion 54 and the connecting portion 50. The upper end of the sloped portion 52 is generally circular and corresponds to shape of the lower end of the sealing portion 54, and the lower end of the sloped portion 52 is generally teardrop-shaped and corresponds to the shape of the upper end of the connecting portion 50. The wall of the sloped portion 52 that extends between the sealing portion 54 and the connecting portion 50 is sloped to allow rain and snow to be guided away from the second opening 66 at the upper end of the collar 14.

The connecting portion 50 of the collar 14 extends from the sloped portion 52 and is configured to provide a connection between the collar 14 and the base 12. The connecting portion 50 of the collar 14 is configured to be connected to the connecting mechanism 18 of the base 12, as described above with respect to the multi-diameter collar 14.

In the embodiment shown in FIG. 7, the connecting portion 50 of the collar 14 is overmolded onto the connecting mechanism 18 of the base 12 in order to fixedly connect the collar 14 to the base 12. As the collar 14 is overmolded onto the base 12, the connecting portion encases all surfaces of the connecting mechanism 18 of the base 12 which includes the connecting portion 50 while filling the apertures 40 formed in the flange 36 of the connecting mechanism 18 of the base 12. The connecting portion 50 extends over the entire outer surface of the connecting mechanism 18 such that a portion of the connecting portion 50 abuts and is attached to the upper surface 28 of the plate 16 to provide a sealed connection between the collar 14 and the base 12. Another portion of the connection portion 50 extends below the flange 36 to abut and attached to the lower surface of the flange 36 and transition 38, thereby providing a complete seal between the connecting portion 50 of the collar 14 and the connecting mechanism 18 of the base 12.

In operation, a flat base 12 is stamped, molded, or otherwise machined to form the connecting mechanism 18 that extends from the plate 16. The machining of the base 12 further removes material to form the apertures 40 formed through the flange 36 of the connecting mechanism 18 as well as the central aperture 30 defined by the connecting mechanism 18. In embodiments in which the collar 14 is overmolded onto the base 12, the base 12 is first placed into a mold. The molding process generates a flexible collar 14 that is integrally connected to the connecting mechanism 18 of the base 12, as shown in FIG. 7. The collar 14 overmolded onto the base 12 can either be a multi-diameter collar 14 or a fixed-diameter collar 14, both described above.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A roof flashing comprising:

a base includes a plate having a top surface and a connecting mechanism extending at an angle from the top surface, wherein the connecting mechanism defines a central aperture formed through the base and comprises a flange having an upper surface, the base further including a diverter extending from the top surface of the plate, wherein the diverter surrounds at least a portion of the connecting mechanism and is spaced apart therefrom, and wherein a plane extends from the top surface of the plate, the plane being perpendicular to the top surface of the plate, the upper surface of the flange being spaced from the top surface of the plate by a first distance along the plane, and an uppermost point of the diverter being spaced from the top surface of the plate by a second distance along the plane, wherein the second distance is greater than the first distance; and, a flexible collar operatively connected to the connecting mechanism of the base, the flexible collar having an opening for receiving and sealing against a pipe.

2. The roof flashing of claim 1, wherein the upper surface of the flange extends laterally around the central aperture in a closed loop path.

3. The roof flashing of claim 1, wherein the connecting mechanism further includes a transition, wherein the transition extends at an angle from the top surface of the plate, and the flange is integrally formed with and extends at an angle from the transition.

4. The roof flashing of claim 3, wherein the transition of the connecting mechanism laterally surrounds the upper surface of the flange in a closed loop path.

5. A roof flashing comprising:

a base includes a plate having a top surface and a connecting mechanism extending at an angle from the top surface, wherein the connecting mechanism defines a central aperture formed through the base and comprises a flange having an upper surface that is substantially parallel to the top surface of the plate, the base further including a diverter extending from the top surface of the plate, wherein the diverter surrounds at least a portion of the connecting mechanism and is spaced apart therefrom, and wherein a plane extends from the top surface of the plate, the plane being perpendicular to the top surface of the plate, the upper surface of the flange being spaced from the top surface of the plate by a first distance along the plane, and an uppermost point of the diverter being spaced from the top surface of the plate by a second distance along the plane, wherein the second distance is greater than the first distance; and, a flexible collar operatively connected to the connecting mechanism of the base, the flexible collar having an opening for receiving and sealing against a pipe.

6. The roof flashing of claim 5, wherein the upper surface of the flange extends laterally around the central aperture in a closed loop path.

7. The roof flashing of claim 5, wherein the connecting mechanism further includes a transition, wherein the transition extends at an angle from the top surface of the plate, and the flange is integrally formed with and extends at an angle from the transition.

8. The roof flashing of claim 7, wherein the transition of the connecting mechanism laterally surrounds the upper surface of the flange in a closed loop path.

9. The roof flashing of claim 1, wherein the connecting mechanism comprises a flange having an upper surface that is substantially parallel to the top surface of the plate.

10. The roof flashing of claim 1, wherein the base is formed from aluminum, galvanized steel, copper, or hard plastic.

11. The roof flashing of claim 3, wherein the flange includes a plurality of apertures formed therethrough.

12. The roof flashing of claim 1, wherein the flexible collar is overmolded onto the connecting mechanism of the base.

13. The roof flashing of claim 1, wherein the flange of the connecting mechanism defines the central aperture.

14. The roof flashing of claim 13, wherein the central aperture that the flange defines is a teardrop-shaped central aperture.

15. The roof flashing of claim 1, wherein the opening of the collar includes a fixed-diameter opening or a user-selectable multi-diameter opening.

16. The roof flashing of claim 1, wherein the collar includes a connecting portion operatively connected to the connecting mechanism of the base, a sloped portion extending from the connecting portion, and a sealing portion extending from the sloped portion, the sealing portion defining an opening to the collar.

17. The roof flashing of claim 16, wherein the sealing portion includes at least a first removable ring extending from an upper end of the sloped portion, the first removable ring being selectively detachable from the sloped portion to increase a diameter of an opening of the sealing portion.

* * * * *